United States Patent [19]

Knabel et al.

[11] Patent Number: 4,572,542

[45] Date of Patent: Feb. 25, 1986

[54] INDICATOR FOR SAFETY SKI BINDING

[75] Inventors: Walter Knabel, Murnau; Gerd Klubitschko, Oberau, both of Fed. Rep. of Germany

[73] Assignee: Marker International, Salt Lake City, Utah

[21] Appl. No.: 453,919

[22] Filed: Dec. 28, 1982

[30] Foreign Application Priority Data

Dec. 29, 1981 [DE] Fed. Rep. of Germany ..... 3151767

[51] Int. Cl.[4] ..... A63C 9/08

[52] U.S. Cl. ..... 280/634

[58] Field of Search ..... 280/634, 632, 631, 628, 280/626; 116/DIG. 11, 283, 281, 282

[56] References Cited

U.S. PATENT DOCUMENTS

| | | | |
|---|---|---|---|
| 3,489,122 | 1/1970 | Schweizer et al. | 280/634 |
| 3,943,882 | 3/1976 | Sollak et al. | 280/634 |
| 4,421,341 | 12/1983 | Krob et al. | 280/628 |

FOREIGN PATENT DOCUMENTS

| | | | |
|---|---|---|---|
| 1728515 | 1/1974 | Fed. Rep. of Germany | 280/631 |

*Primary Examiner*—David M. Mitchell

*Attorney, Agent, or Firm*—D. Peter Hochberg

[57] ABSTRACT

An indicator in a grasping piece of a safety ski binding for indicating the setting of an adjustable operating characteristic, including a window and an elongated indicating member operatively connected at one end to the operating characteristic adjusting means, the opposite end of the indicating member bearing on the window, the indicating member being supported intermediate its ends.

14 Claims, 3 Drawing Figures

INDICATOR FOR SAFETY SKI BINDING

BACKGROUND OF THE INVENTION

The present invention relates to safety ski bindings including an indicator for displaying the setting of an adjustable operating characteristic such as release force.

Known safety ski bindings include at least one grasping piece such as a heel piece or toe piece for grasping a portion of a ski boot. Each grasping piece includes a stationary part fixed to a ski and a pivoting part connected by an axle to the stationary part. Some of these heel and toe pieces include an indicator, visible through a window in the pivoting part and having an adjacent scale, to indicate the setting of an adjustable operating characteristic, such as release force, for the heel or toe piece. Generally, the setting is adjustable by the turning of a screw which engages and compresses or releases the compression of a spring. Turning the screw also causes movement of the indicator relative to the scale. In these known heel and toe pieces, the indicator is fixed to the stationary part and can be accurately read only when the heel or toe piece is latched. These known indicators must also be adjusted to compensate for a change from one ski boot to another having a different sole thickness. These indicating bindings also require a substantial force to lock them. Therefore they are not convenient to latch when the ski is resting on deep snow.

It is desirable to provide an indicator which remains in the window adjacent to the scale in the heel or toe piece, which does not require adjustment to accommodate different ski boot sole thicknesses and which is easy to latch.

SUMMARY OF THE INVENTION

In the present invention an indicator indicating the setting of an adjustable operating characteristic means is provided in the toe or heel piece of a safety ski binding. The indicator remains in the window and does not require a ski boot thickness compensation adjustment. The indicator is attached at one end to the adjusting means so that adjustment of the adjusting means drives the indicator. The opposite end of the indicator bears against the window. The indicator is supported intermediate of its ends by the axle on which the pivoting part of the toe or heel piece is pivoted with respect to the fixed part.

In some embodiments of the invention the indicator is a resilient elongated member and its own resiliency maintains the desired contact between the indicator and window. A guide may be provided on the axle to support the member and to prevent the resilient member from being damaged by excessive bending. Another embodiment includes a pivoting, biased guide member engaging and supporting the indicator intermediate its ends. The member need not be resilient in this embodiment since the guide member is biased to cause the indicator to bear on the window.

In all these embodiments, the indicator bears upon the window to ensure readability of the indicator.

DETAILED DESCRIPTION OF PREFERRED EMBODIMENTS

The figures show an embodiment of the invention included in a heel piece for grasping the heel portion of a ski boot. A totally analogous installation, which would be obvious to one of skill in the art, of the inventive indicator may be made in a toe piece of a ski binding for grasping the toe portion of a ski boot.

Figure 1:
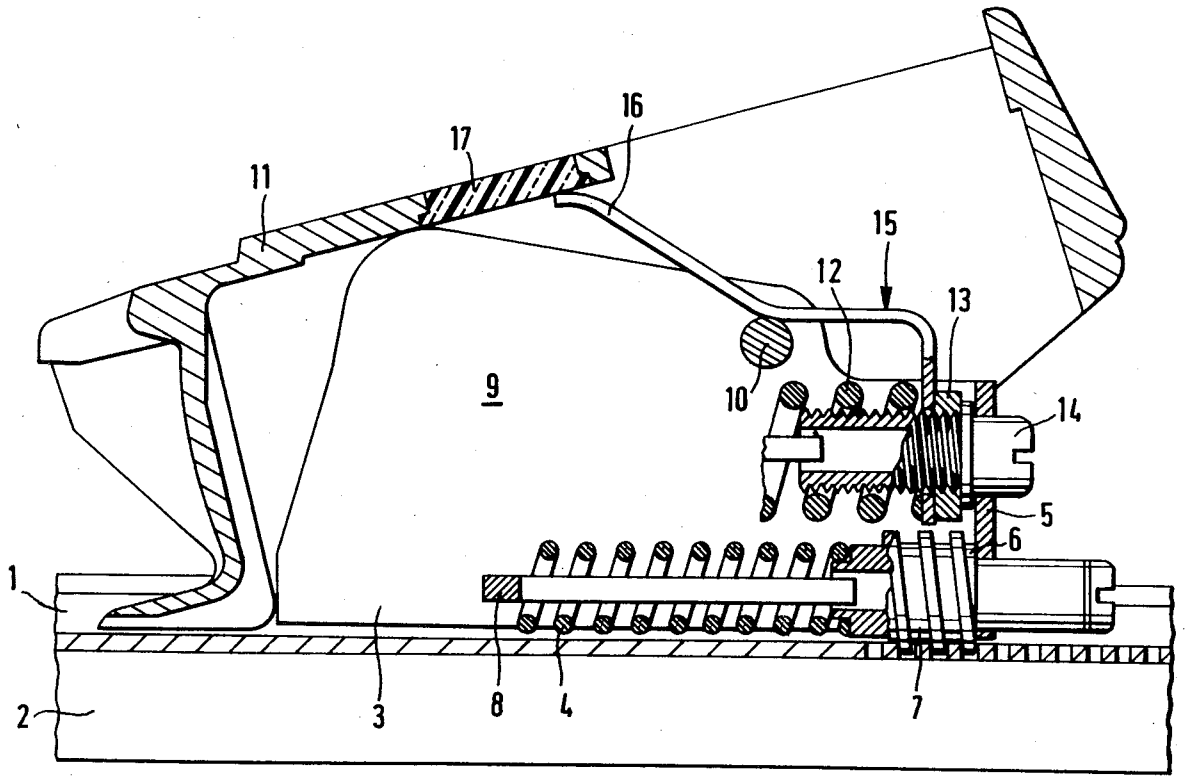
FIG. 1 is a cross sectional side view of a heel piece including an embodiment of the invention.

In FIG. 1 a sectional side view of a heel piece for a safety ski binding is shown. The heel piece is intended to grasp the heel portion of a sole of a ski boot and hold it in place so long as the binding is in its latching position. When the skiing forces transmitted by the ski boot to the heel piece exceed a release force threshold, the heel piece switches to its releasing position, releasing its grip on the ski boot.

The depicted heel piece includes a base plate 1 for attachment of the heel piece to a ski 2 by conventional means, such as screws. A stationary part of the heel piece having a pair of opposing side walls, including a side wall 9 visible in the figure, is mounted on base plate 1 and includes a moveable carriage 3. A helical spring 4 drives carriage 3 by virtue of an attachment 8 between carriage 3 and a shaft mounted within spring 4. One end of spring 4 bears on attachment 8. The end of the shaft opposite attachment 8 is disposed within a threaded barrel 7. The threads of barrel 7 engages complementary screw threads in base plate 1. At the end of spring 4 opposite that joined to attachment 8, spring 4 bears on barrel 7. A shoulder 6 on barrel 7 bears on a back wall 5 of the stationary part. A slotted head extends from barrel 7 beyond back wall 5. Turning the slotted head with a screwdriver adjusts the compression of spring 4 and the position of the heel piece on base plate 1 and on ski 2. Thereby the pressure applied by the heel piece to a ski boot inserted into the binding may be varied. Side wall 9 includes a transverse axle 10 fixed to and through which a pivoting part of the heel piece, including an upper wall 11, is pivotally attached to the stationary part of the heel piece. Axle 10 is designated as transverse because it lies across the width of ski 2 rather than along its length.

The force release threshold is adjusted in a conventional manner, which is therefore not explained here in detail, through a helical spring 12 surrounding a threaded shaft. The threaded shaft includes a slotted head 14 protruding through wall 5. A threaded nut 13, which is mounted to prevent its rotation relative to the threaded shaft, engages the shaft to increase or release the compression of spring 12 as head 14 is turned, preferably with a screwdriver.

An elongated indicator member 15 is fixed at one of its ends to nut 13. The movement of nut 13 relative to the shaft as head 14 is turned results in the movement of indicator 15. The opposite end 16 of indicator 15 bears against a window 17 in upper wall 11. Indicator 15 is supported intermediate its ends by axle 10. End 16 of the indicator is maintained against window 17 by means of the support provided by axle 10 and the resiliency of indicator 15. Indicator 15, or at least end 16 in this embodiment, is preferably made of a spring material which is formed so that the free end naturally presses upward against a downward restraining force such as supplied by window 17. Window 17 could be merely an opening through which indicator end 16 could protrude. However, it is preferred that window 17 be formed of a plastic or other transparent material to exclude foreign matter from the internal parts of the heel piece. Preferably a scale is fixed in wall 11 or directly against window 17 for reading the relative position of indicator end 16.

When the heel piece is latched, as shown, indicator end 16 bears on window 17. When the pivoting part moves while the heel piece is latched, indicator end 16 remains in contact with window 17 by means of its inherent resiliency. Therefore, the contact between window and indicator end is maintained regardless of the movement of the pivoting part within its elastic range, or a variation in a boot sole thickness. When the pivoting part of the heel piece moves to its releasing position, contact between indicator end 16 and the window may be lost.

Figure 2:
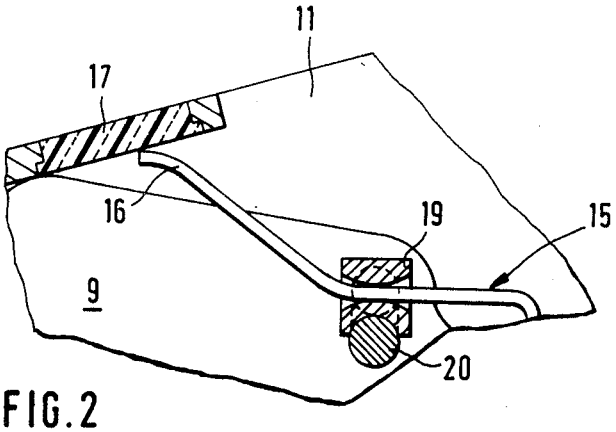
FIG. 2 is a partial cross sectional side view of a heel piece including an embodiment of the invention.

In FIG. 2, a view of another embodiment of the indicator is shown. A complete depiction of the stationary and pivoting parts of the heel piece are omitted in this view, but all or part of many of the same elements shown in FIG. 1 are shown in FIG. 2 and are given the same reference numerals. For example, stationary side wall 9 and pivoting part 11 are shown in part. In this embodiment, the support given indicator member 15 intermediate its ends is provided by a guide 19 that is fixed to a transverse axle 20. Axle 20 connects the pivoting and stationary parts 11 and 9 and moves with pivoting part 9. Guide 19 includes opposing jaws which engage member 15. The jaws diverge from each other, at least at the opening toward indicator end 16, to permit the flexing of end 16 in response to movement of the pivoting part and window 17. The flexing limits imposed by the jaws of guide 19 prevent excessive flexing which might damage member 15. When the pivoting part pivots upon release of the heel piece, guide 19 is pivoted with axle 20 to maintain contact between indicator end 16 and window 17.

Figure 3:
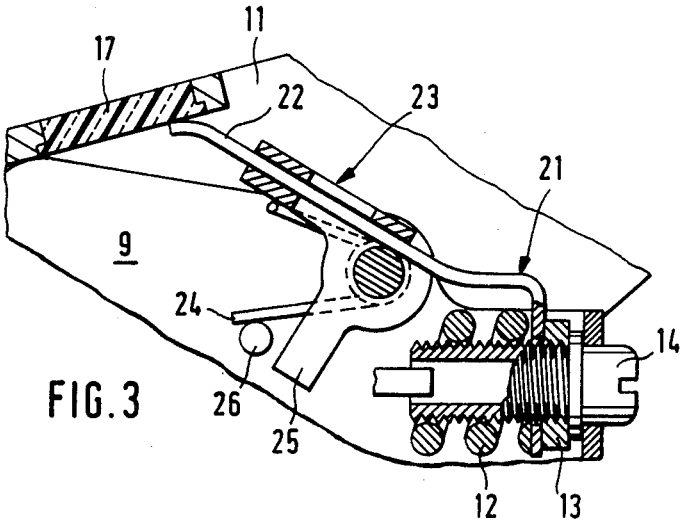
FIG. 3 is a partial cross sectional view of a heel piece including an embodiment of the invention.

In FIG. 3, still another embodiment of the invention is shown. Again, some of the elements shown in FIG. 1 are omitted and the numbering scheme for elements carried over from FIG. 1 is generally repeated. An indicator member 21 is again attached to nut 13 and includes an end 22 which bears on window 17. A guide 23 is pivotally mounted on axle 20 and includes a pair of opposing jaws which engage member 21. In addition, member 21 is engaged by a single jaw opposite axle 20. Axle 20 provides support to member 21 intermediate its ends and with the single jaw engages member 21. A helical spring 24 having elongated ends is pivotally engaged around axle 20. One end of spring 24 bears on a pin 26 mounted in side wall 9 and the other end of spring 24 engages guide 23. The biasing force of spring 24 urges guide 23 to rotate, clockwise as shown in FIG. 3, so as to maintain contact between window 17 and indicator end 22. A downwardly extending arm 25 on guide 23 engages pin 26 when the heel piece is in its released position. Pin 26 acts as a stop preventing undue bending of indicator 23 when the heel piece is released. In this embodiment, indicator 21 need not be naturally resilient. Guide 23 provides the biasing force to maintain window and indicator contact. Stop 26 limits the rotation of guide 23 and thereby prevents guide 23 from bending indicator 21.

In all the embodiments described, the indicator adds no significant additional force to that normally required to latch the heel piece. Since the indicator and window remain in contact throughout the elastic range of the latched heel piece (and even during much of the range of movement in the released heel piece), there is no need to provide an indicator adjustment to accomodate varying ski boot heel thicknesses.

The invention has been described with reference to certain preferred embodiments. Those of skill in the art with recognize various sustitutions, additions and modifications without departing from the spirit of the invention. Accordingly, the scope of the invention is limited solely by the following claims.

We claim:

1. An indicator in a safety ski binding, said binding including at least one grasping piece having latching and releasing positions for latching and releasing a portion of a ski boot, respectively, said grasping piece comprising:

a stationary part fixable to a ski and including adjusting means for adjusting an operating characteristic of the grasping piece;

a pivoting part pivotally connected to said stationary part along a transverse axle for engaging a ski boot;

window means in said pivoting part for viewing an indicator means; and indicator means for indicating the setting of said adjusting means including first and second ends, said first end being connected to said adjusting means for movement in response to adjustment of said adjusting means, said axle supporting said indicator means intermediate said first and seconds ends, and said second end bearing on said window means.

2. The invention according to claim 1, said window means comprising a transparent material attached to said pivoting part.

3. The invention according to claim 1 wherein said adjusting means adjusts the release force for releasing said grasping piece from its latching position to its releasing position.

4. The invention according to claim 1, said indicator means comprising a resilient elongated member.

5. The invention according to claim 1 further including guide means attached to said axle, said guide means engaging said indicator means intermediate said first and second ends.

6. The invention according to claim 5 wherein said axle is fixed to said pivoting part.

7. The invention according to claim 6 wherein said guide means includes opposing, arcuate jaws engaging said indicator means intermediate said first and second ends.

8. The invention according to claim 5, wherein said guide means is pivotally attached to said axle and further including biasing means for urging said second end to bear on said window means.

9. The invention according to claim 8 wherein said biasing means comprises a spring biasing said guide means to urge said indicator means to bear on said window means.

10. The invention according to claim 8, said guide means including jaws engaging said indicator means intermediate said first and second ends.

11. The invention according to claim 8 further including stop means mounted on said stationary part for limiting movement of said guide means to prevent bending of said indicator means, said guide means including an arm for engaging said stop means when said grasping piece is in its releasing position.

12. The invention according to claim 1 wherein said first end bears upon said window means when said grasping piece is in its latching position.

13. The invention according to claim 1 wherein said grasping piece is a heel piece.

14. An indicator in a safety ski binding, said binding including at least one grasping piece having latching and releasing positions for latching and releasing a portion of a ski boot, respectively, said grasping piece comprising:

a stationary part fixable to a ski and including adjusting means for adjusting an operating characteristic of the grasping piece;

a pivoting part pivotally connected to said stationary part for engaging a ski boot;

window means in said pivoting part for viewing an indicator means; and indicator means for indicating the setting of said adjusting means including first and second ends, said first end being connected to said adjusting means for movement in response to adjustment of said adjusting means and said second end bearing on said window means.

* * * * *